US005284121A

United States Patent [19]

Abe et al.

[11] Patent Number: 5,284,121

[45] Date of Patent: Feb. 8, 1994

[54] INTERNAL COMBUSTION ENGINE WITH EVAPORATED FUEL PURGE SYSTEM

[75] Inventors: Seiko Abe, Okazaki; Toshihiko Igashira, Toyokawa; Yasuyuki Sakakibara, Nishio, all of Japan

[73] Assignee: Nippon Soken, Inc., Nishio, Japan

[21] Appl. No.: 917,209

[22] Filed: Jul. 22, 1992

[30] Foreign Application Priority Data

Jul. 26, 1991 [JP] Japan ..... 3-187802
Oct. 21, 1991 [JP] Japan ..... 3-272789

[51] Int. Cl.[5] ..... F02M 37/04

[52] U.S. Cl. ..... 123/520; 123/198 D

[58] Field of Search ..... 123/198 D, 516, 518, 123/519, 520, 521

[56] References Cited

U.S. PATENT DOCUMENTS

| | | | |
|---|---|---|---|
| 4,748,959 | 6/1988 | Cook | 123/520 |
| 4,949,695 | 8/1990 | Uranashi | 123/198 D |
| 5,048,492 | 9/1991 | Davenport | 123/520 |
| 5,054,454 | 10/1991 | Hamburg | 123/520 |
| 5,067,469 | 11/1991 | Hamburg | 123/520 |
| 5,080,078 | 1/1992 | Hamburg | 123/519 |

FOREIGN PATENT DOCUMENTS 57-52663 3/1982 Japan .

OTHER PUBLICATIONS

Iida et al Appln. No. 07/863091, Filed Apr. 3, 1992.

Nakashima et al Appln. No. 07/864728, Filed Apr. 7, 1992.

*Primary Examiner*—Carl S. Miller

*Attorney, Agent, or Firm*—Cushman, Darby & Cushman

[57] ABSTRACT

An internal combustion engine has an evaporated fuel purge system for directly feeding evaporated fuel of a fuel tank into an intake pipe of the engine during the engine is running. This system comprises a purge control valve for opening or closing a flow line which connects an upper space of the fuel tank with the intake pipe, a controller for controlling the operation of the valve, a throttle section formed in series with the purge control valve, and pressure and temperature sensors which are located on the upstream side of the throttle section for detecting a pressure and a temperature of the evaporated fuel. When a value detected by the pressure sensor exceeds a predetermined value of pressure for providing a critical pressure ratio at which a flow rate of the evaporated fuel at the throttle section substantially equals to a sonic velocity, the controller opens the purge control valve to cause a purged flow of the evaporated fuel whose flow rate is constant. Simultaneously, the controller calculates a purged flow rate of the evaporated fuel from the detected values of the pressure and temperature sensors and a time period during which the purge control valve is opened. On the basis of the calculated purged flow rate, a reduction correction is made to an amount of the fuel to be supplied to the engine in order to maintain an air-fuel ratio in the optimum condition. The calculated purged flow rate may be indicated.

12 Claims, 11 Drawing Sheets

INTERNAL COMBUSTION ENGINE WITH EVAPORATED FUEL PURGE SYSTEM

BACKGROUND OF THE INVENTION

The present invention relates to an internal combustion engine (hereinafter, referred to simply as an engine) having an evaporated fuel purge system. This evaporated fuel purge system is adapted to allow, fuel vapor produced in a fuel tank to be directly sucked into an intake pipe of the engine in order to dispose of the fuel vapor.

A conventional example of a control method for purging evaporated fuel in a fuel tank or the like is disclosed in, for example, Japanese Patent Unexamined Publication No. 57-52663. Most of conventional evaporated fuel disposal systems, including the system disclosed in the above publication, are provided with charcoal canisters and are adapted to cause fuel vapor produced in fuel tanks to be once adsorbed by active carbon within the charcoal canisters. The fuel vapor thus adsorbed is discharged from the charcoal canisters and sucked into combustion chambers of engines at the time when the fuel vapor will not exert bad influence on the operation of the engines even if the fuel vapor is additionally mixed with intake air, for instance, at the time when the engines are driven under high load. In other words, in the engines with the conventional systems of this kind, the charcoal canisters are used for storage of the evaporated fuel even during the engines are running.

In the conventional system, as described above, the evaporated fuel is once stored in the charcoal canister even when the engine runs, and only when the engine comes into an operating state which is suitable for purging the evaporated fuel, a valve provided on a purge pipe is opened for allowing the fuel vapor to be sucked from the charcoal canister into combustion chambers of the engine. Thus, the charcoal canister is required to have a sufficiently large adsorption capacity, and it is generally difficult to form the canister into a compact size. Also, deterioration in adsorbing ability of the active carbon is a matter to be considered because the canister has to continuously adsorb the fuel vapor. Further, in the case where an amount of production of the evaporated fuel exceeds the adsorption capacity of the canister, there is a possibility that the fuel vapor will be directly discharged to the atmosphere.

SUMMARY OF THE INVENTION

The invention has an object of providing an engine including an evaporated fuel purge system which need not have a charcoal canister of a large adsorption capacity, and accordingly, can be reduced in size as a whole.

Another object of the invention is to provide an engine including an evaporated fuel purge system which is compact in size and has a high durability.

Still another object of the invention is to provide an engine including an evaporated fuel purge system which is of a compact size and enables a stable operation of the engine.

The present invention is intended to allow the evaporated fuel to be directly sucked into combustion chambers of an engine without passing through a charcoal canister during operation of the engine in order to achieve the above objects.

According to the prior art, however, a rate of the evaporated fuel being purged is not determined accurately before it flows into the engine. For this reason, a total amount of the fuel being supplied to the engine cannot be known precisely. The evaporated fuel additionally mixed with intake air causes an air-fuel ratio of the intake air to be somewhat varied. As a result, it is difficult to purge the evaporated fuel into the intake air while the engine is always driven stably in the optimum state.

Therefore, according to one aspect of the invention, when the fuel vapor is directly fed to the combustion chambers of the engine without flowing through the charcoal canister, the flow rate of the fuel vapor being purged is measured accurately and a flow rate of the fuel to be injected from an injector is subtracted by the flow rate of the fuel vapor being purged, thereby preventing the variation of the air-fuel ratio of the engine.

Also, according to another aspect of the invention, at the time of purging the fuel vapor, the flow rate of the fuel vapor being purged is measured precisely and the purged flow rate is indicated.

More specifically, according to the above-described one aspect of the invention, an internal combustion engine comprises a fuel tank, an intake pipe for supplying air to the engine, an injector for injecting fuel into a flow of the air passing through the intake pipe, and an evaporated fuel purge system, wherein the system includes an evaporated fuel flow line through which an upper space of the fuel tank communicates with the intake pipe, at least one purge control valve for opening and closing the evaporated fuel flow line to allow the evaporated fuel in the fuel tank to flow into the intake pipe, a throttle section provided in the evaporated fuel flow line in series with the purge control valve, a pressure sensor for detecting a pressure in the evaporated fuel flow line at a position on the upstream side of either the purge control valve or the throttle section which is on the more upstream side than the other, a temperature sensor for detecting a temperature in the evaporated fuel flow line on the upstream of the throttle section, and a controller operatively connected to the injector, the purge control valve, the pressure sensor and the temperature sensor. In the controller, predetermined is a certain pressure value providing a critical pressure ratio at which a flowing velocity of the evaporated fuel at the throttle section equals to a sonic velocity. The controller opens the purge control valve when the detected value of the pressure sensor exceeds the predetermined pressure value, and when the purge control valve is opened, the controller counts a time period during which the valve is opened. The controller calculates a purged flow rate of the evaporated fuel on the basis of the detected values of the pressure sensor and the temperature sensor and the period of the purge control valve opening time, and operates to make a correction of reducing a rate of the fuel to be injected from the injector by a fuel rate corresponding to the purged flow rate of the evaporated fuel.

With the above arrangement, when the engine is driven and the vapor pressure of the evaporated fuel in the fuel tank becomes high, the pressure on the upstream side of one of the purge control valve and the throttle section formed in series with the valve, which is on the more upstream side than the other, increases and the pressure sensor detects the pressure. When the value of the detected pressure exceeds a certain value, to say nothing of a case where the engine is in a high-load driving state, even when it is in a low-load driving state, the controller opens the purge control valve. As a result, the evaporated fuel is sucked from the upper space of the fuel tank into the the intake pipe so as to be burnt with the intake air within the combustion chambers of the engine. Thus, the evaporated fuel can be disposed effectively.

At this time, the pressure ratio of the pressures on the upstream and downstream sides of the throttle section is over the critical pressure ratio so that the velocity of the fuel vapor flowing through the throttle section equals to the sonic velocity (a constant value) and it does not become larger. Accordingly, the flow rate of the fuel vapor depends on a cross-sectional are of the throttle section and the pressure and temperature on the upstream side of the throttle section, which have influence on a density of the evaporated fuel. The cross-sectional area of the throttle section is predetermined and constant, and the pressure and temperature on the upstream side of the throttle section are detected by the respective sensors. Under such condition, the controller can calculate a precise flow rate of purging of the evaporated fuel, i.e., an amount of the fuel added to the intake air, by finding a time period of opening of the purge control valve in addition to the data from the sensors.

Also, in the above arrangement, the controller further operates to effect a reduction correction on a flow rate of the fuel injected from the injector by the calculated rate of the additional fuel. Under such control, it is possible to correctly adjust the air-fuel ratio during the purging to an aimed value even when the engine is in the low-load driving state, while in such state of the engine, according to the prior art, it was difficult to purge the evaporated fuel. Therefore, according to the invention, the engine can be driven stably without causing a variation of the air-fuel ratio.

In the case where a charcoal canister is provided, the canister has only to adsorb the evaporated fuel when the engine is stopped, so that it needs only a relatively small adsorbing capacity and a durability of active carbon used in the canister is also improved.

Meanwhile, in the internal combustion engine according to another aspect of the invention, the evaporated fuel is purged into the intake pipe in the same manner as described above, and the calculated precise flow rate of the purged fuel is indicated.

BRIEF DESCRIPTION OF THE DRAWINGS

These and other objects, features and advantages of the invention will become more apparent from the detailed description which will be made with reference to the accompanying drawings. In these drawings.

DETAILED DESCRIPTION OF THE INVENTION

Figure 1:
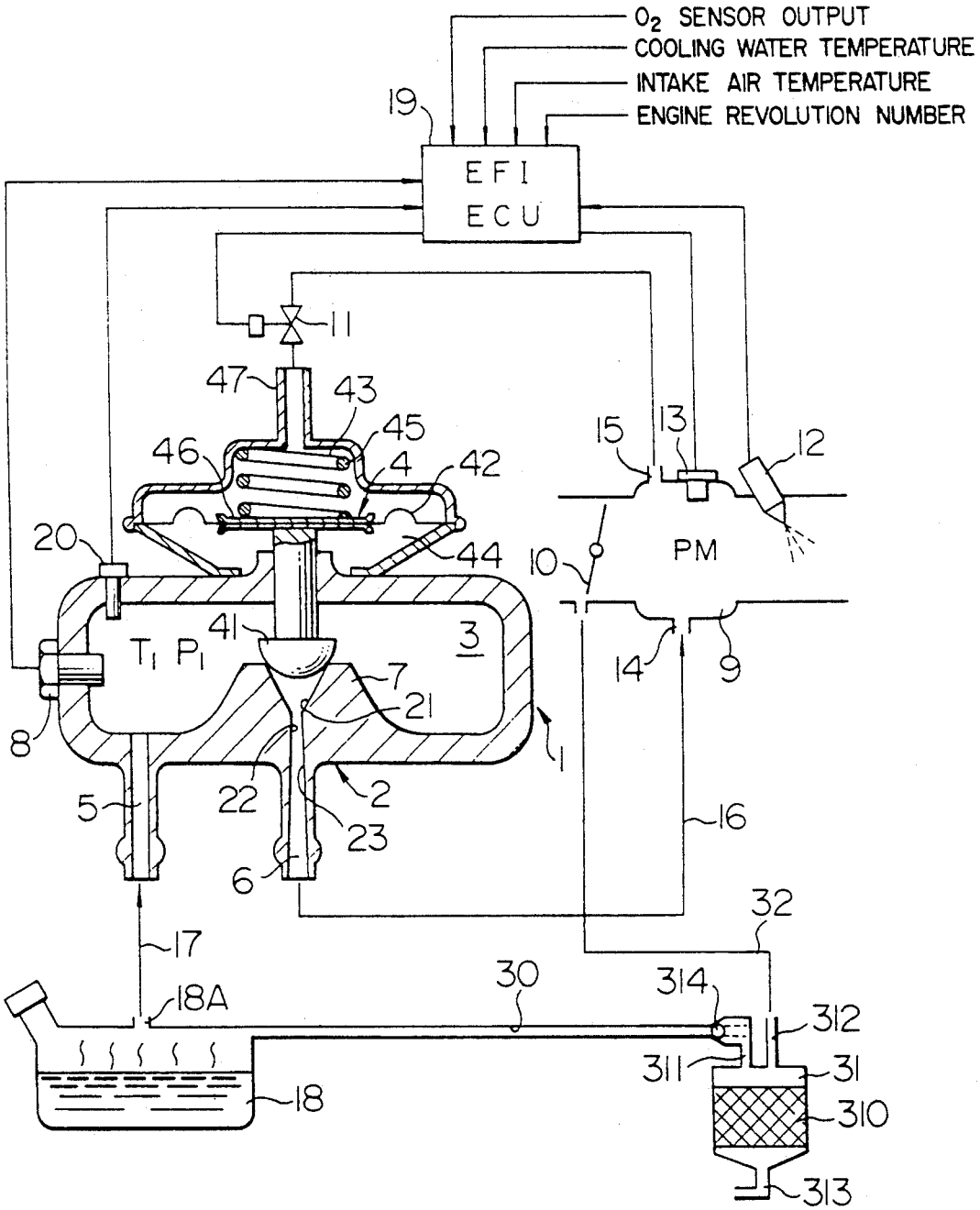
FIG. 1 is a view showing the constitution or arrangement of an engine according to the first embodiment of the invention.

The engine with an evaporated fuel purge system according to the invention will now be described with reference to the embodiments shown in the drawings.

FIG. 1 is a view illustrating the arrangement of an engine according to the first embodiment of the invention. Incidentally, in the engine of the invention, an engine main body, an ignition system and so on may be the conventional ones, and a description thereof will be omitted herein.

The engine of the illustrated embodiment includes an intake pipe 9 leading to the engine main body, a fuel tank 18, a charcoal canister 31, a purge control valve 1 and an electronic control unit (ECU) 19 for an electronically controlled fuel injection system (EFI).

The purge control valve 1 regulates a flow rate of purging of evaporated fuel from the fuel tank. The purge control valve 1 is provided with a sonic nozzle 2, a hollow surge tank 3, a diaphragm-type poppet valve 4, a vapor inlet and a vapor outlet 6.

The surge tank 3 includes a thick wall portion formed at the central portion of the bottom, the wall portion being formed with a hole penetrating therethrough. There is formed at an inner opening edge of the hole a valve seat portion 7 for reception of a valve disc 41 of the poppet valve 4. The wall of the seat portion 7 conically extends downwardly to form a nozzle portion 21. The nozzle portion 21 is smoothly curved and tapered in cross-section. The hole also includes a throat portion 22 extending from the nozzle 21 and a flared or larval pipe portion 23, the flared pipe portion 23 communicating with the throat portion 22. The nozzle portion 21, the throat portion 22 and the flared pipe portion 23 constitutes the sonic nozzle 2. The throat portion 22 has a diameter of 1.5 mm and a length of 1 mm. The flared pipe portion 23 extends from the throat portion at an angle of 5° to 10°, and connects with the vapor outlet 6.

The surge tank 3 also serves as a casing of the valve 1 and, in the illustrated embodiment, a volume of the surge tank 3 is about 200 $cm^3$. The vapor inlet 5 is formed at one portion of the wall of the surge tank 3 and extends therethrough so as to communicate the inner space of the surge tank 3 with the outside of the surge tank 3. A pressure sensor 8 for detecting a pressure within the surge tank 3, that is, a pressure $P_1$ on the upstream side of the nozzle and a temperature sensor 20 for detecting a vapor temperature $T_1$ are provided at other portions of the wall of the surge tank 3. Further, an outer shell of the poppet valve 4 is securely connected to the upper portion of the surge tank 3.

The poppet valve 4 includes a diaphragm 42, chambers 43, 44 on the upper and lower sides of the diaphragm 42 and a spring 45, besides the valve disc 41. The valve disc 41 is fixed to the diaphragm 42 through a plate 46, and extends downwardly from the diaphragm 42. The diaphragm lower chamber 44 is in communication with the atmosphere, while the upper chamber 43 is in communication with a negative pressure port 15 of the intake pipe 9 via a negative pressure induction pipe 47 and an ON-OFF valve 11.

The vapor outlet 6 of the control valve 1 is in communication with the throat portion 22 and leads to a purge port 14 of the intake pipe 9 through a conduit 16. The vapor inlet 5 communicates with a vapor outlet 18A opening to an upper space of the fuel tank 18 via a conduit 17.

The intake pipe 9 is provided with a throttle valve 10, and the negative pressure port 15 is located on the downstream side of the throttle valve 10, and the purge port 14 is located on the downstream side with respect to the negative pressure port 15. An injector 12 for injecting fuel and a pressure sensor (MAP sensor) 13 for detecting a pressure within the intake pipe are mounted on the intake pipe 9. A rate of the fuel injected by the injector 12 is determined on the basis of a detected value PM of the pressure sensor 13 and a number N of revolution of the engine.

The controller 19 mainly operates to control a rate of fuel to be injected to the engine. An output tOX of an $O^2$ sensor mounted on an exhaust pipe (not shown), a temperature of engine cooling water THW, the intake pipe pressure PM, a temperature of the intake air THA, the number N of revolution of the engine, the pressure $P_1$ in the surge tank 3 of the purge control valve 1 (pressure on the upstream side of the nozzle), and the vapor temperature $T_1$ are supplied to the controller 19. The controller 19 outputs a signal for driving the injector 12 and a signal for driving the ON-OFF valve 11.

The fuel tank 18 is, in addition to the conduit 17, further provided with a vapor line 30 connected to the upper space 18A, the vapor line 30 leading to the charcoal canister 31. The charcoal canister 31 consists of an active carbon layer 310 for adsorbing and releasing the fuel vapor, a vapor inlet 311, a purge port 312, an atmosphere introduction port 313 and so on. A check valve 314 is provided on the vapor line 30. This check valve opens to feed the fuel vapor into the canister 31 when the pressure of the fuel vapor in the fuel tank exceeds a predetermined value. The purge port 312 connects with the interior of the intake pipe 9 at a portion immediately before the throttle valve 10.

The basic operation of the electronically controlled fuel injection system (EFI), used also in the invention, will now be described with reference to the flowchart of FIG. 2.

Figure 2:
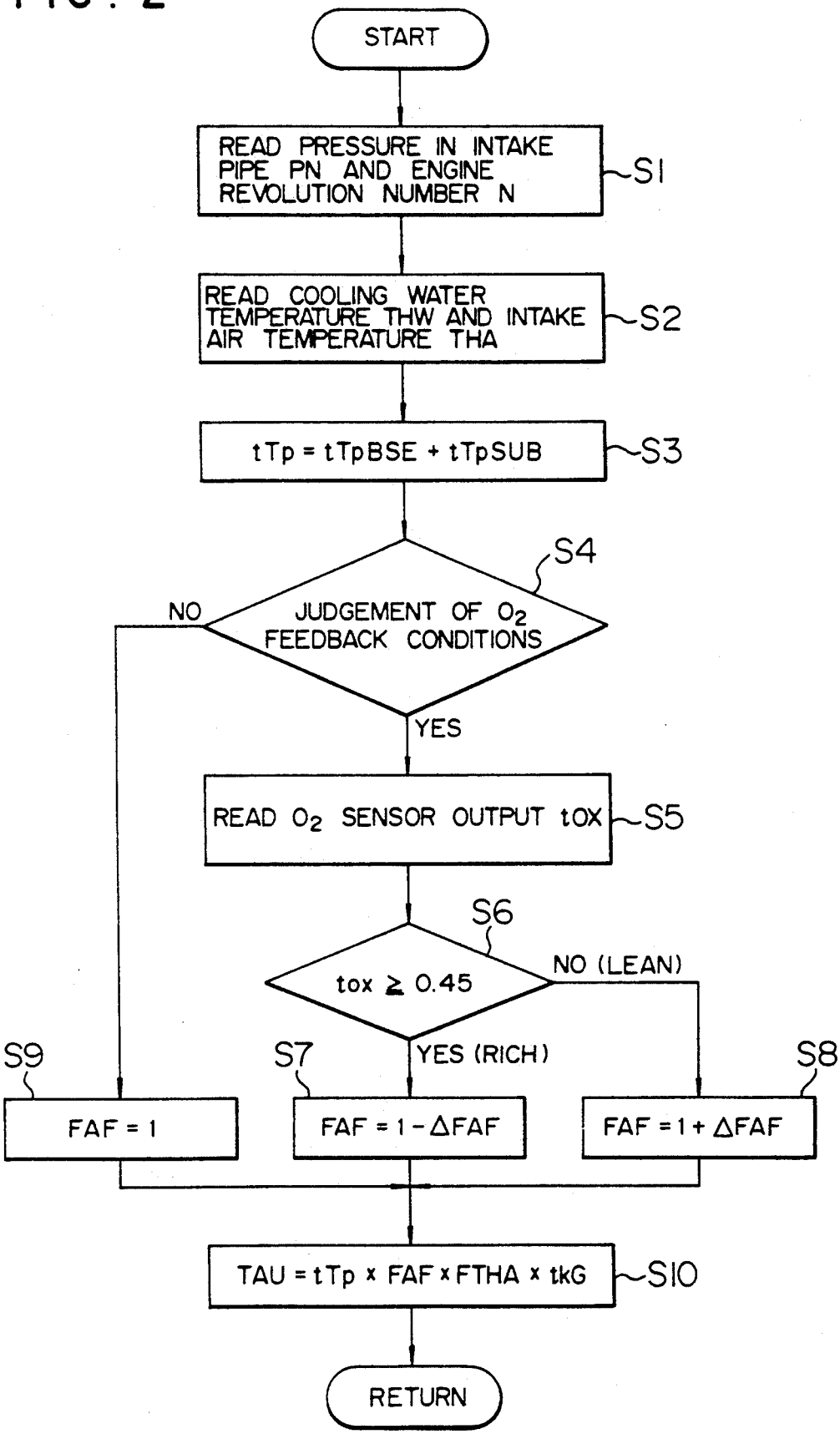
FIG. 2 is a flowchart illustrating the a basic operation of an electronic control type fuel injection system.

In the flowchart of FIG. 2, when a program starts, at a step S1, the pressure PM within the intake pipe 9 and the number N of revolution of the engine are first read in a microprocessor of the electronic control unit (ECU) 19. Then, the engine cooling water temperature THW and the intake air temperature THA are read in the microprocessor at a step S2. Subsequently, at a step S3, a reference injection time $tT^P$ is calculated on the basis of these values. The reference injection time $tT^P$ is found by adding a reference value $tT^PBSE$ determined by the absolute pressure PM in the intake pipe to a correction value $tT^PSUB$ of the reference value $tT^PBSE$ determined by the pressure PM and the engine revolution number N.

The program then proceeds to a step S4, where a judgement of $O_2$ feedback conditions is carried out. More specifically, it is judged whether the engine cooling water temperature THW exceeds 50° C. or not, or whether the fuel supply is interrupted or continues. If the conditions are allowed to operate the feedback, the process advances to a step S5. At the step S5, the output tOX of the $O_2$ sensor (not shown) is read. The program proceeds to a step S6, where it is judged if the output tOX is equal to or more than 0.45. The predetermined value 0.45 represents a value of an output voltage corresponding to a theoretical air-fuel ratio 14.7 of the $O_2$ sensor. Accordingly, the air-fuel ratio is judged to be rich at the step S6 if tOX is equal to or more than 0.45, and then the program proceeds to a step S7. On the contrary, the air-fuel ratio is judged to be lean if tOX is smaller than 0.45, and then the program proceeds to a step S8.

At these steps S6 to S8, a correction value of fuel injection is determined. More specifically, when the air-fuel ratio is judged to be rich at the step S6, a feedback correction factor (FAF) is found to be smaller than 1 at the step S7. That is to say, in this case, FAF is a value obtained by subtracting a value of ΔFAF from 1. Contrarily, when the air-fuel ratio is judged to be lean at the step S6, FAF is a value obtained by adding the value of ΔFAF to 1 at the step S8. In the case where the $O_2$ feedback conditions are judged to be NO at the step S4, FAF is decided to be 1 at a step S9.

The program further proceeds to a step S10, where a final injection time TAU is calculated. TAU is obtained by multiplying the reference injection time tTP and the respective correction values together. In other words, in this case, the feedback correction factor FAF obtained at the steps S6 to S8, an intake air temperature correction factor FTHA, other correction factors tKG are multiplied together. Thus, the injector 12 is controlled by the obtained injection time TAU, and the program returns to START.

The basic operation of the electronically controlled fuel injection system has been explained so far. In the present invention, a control operation for purging the fuel vapor is simultaneously conducted. The operation of the purge system according to the first embodiment of the invention will be described hereinafter with reference to FIGS. 3A to 5.

At first, a characteristic of the sonic nozzle 2 will be explained. The sonic nozzle 2 with the above-described tapered vertical section has such a property as to be mentioned below. More specifically, when the pressure $P_2$ on the downstream side of the nozzle is decreased while the nozzle upstream-side pressure $P_1$ and the temperature $T_1$ are maintained at certain values, a flow rate G of the fuel flowing through the nozzle 2 is gradually increased at the beginning, and it reaches a maximum value at a certain pressure $P_c$. The flow rate is not changed after it reaches the maximum value even if $P_2$ is further decreased. The pressure $P_c$ at this time is referred to as a critical pressure, and a pressure ratio $P_c/P_1$ is referred to as a critical pressure ratio. This critical pressure ratio is obtained by the following formula:

$$\frac{P_c}{P_1} = \left(\frac{2}{K+1}\right)^{\frac{K}{K-1}} \quad (1)$$

wherein K represents a ratio of specific heat of a fluid. The critical pressure ratio $P_c/P_1$ is slightly different depending on the kind of fluid, and in case of air, the critical pressure ratio is 0.528.

A velocity $V_c$ at the outlet of the nozzle under the above condition is obtained by the following formula:

$$V_c = \sqrt{\frac{2gK}{K+1} RT_1} \quad (2)$$

The velocity substantially equals to a sonic velocity (314 m/s). In this formula, R indicates a gas constant, $T_1$ indicates an absolute temperature, and g indicates a gravitational acceleration.

The flow rate G at this time is referred to as a critical flow rate, which critical flow rate can be obtained by the following formula:

$$G = A\frac{P_1}{\sqrt{T_1}}\sqrt{\frac{Kg}{R}\left(\frac{2}{K+1}\right)^{\frac{K}{K+1}}} \quad (3)$$

where A represents an area of the throat. Succeedingly, if the pressure $P_1$ on the upstream side of the nozzle 2 and the temperature $T_1$ are detected, the flow rate G can be obtained.

In the engine of the invention, the purge control valve 1 is provided with the sonic nozzle 2. In the sonic nozzle 2, on the basis of the above principle, a region of a pressure ratio for causing the fuel to flow at a constant flow rate is enlarged by connecting the throat portion 22 and the flared pipe portion 23 to the tapered nozzle portion 21.

Figure 5A:
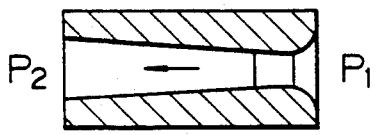
FIGS. 5A and 5B is a diagram show a sonic nozzle and a characteristic of a sonic nozzle which can be used in the invention.
Figure 5B:
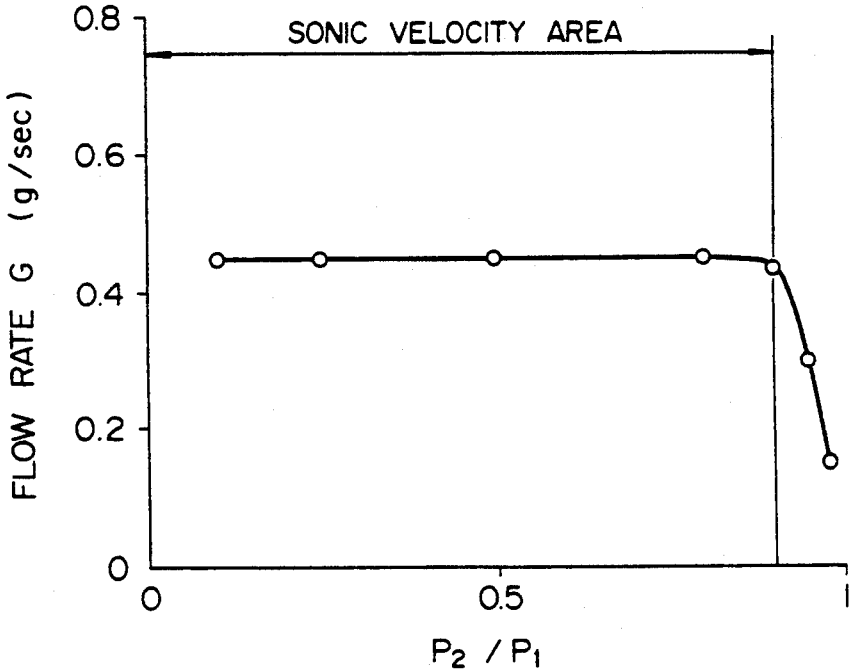

FIG. 5 indicates a result of measurement of the flow rate G with respect to the pressure ratio $P_2/P_1$ in the sonic nozzle sole body. It is understood from this diagram that the flow rate G is constant until the pressure ratio becomes approximately 0.9. Besides, the diameter of the throat portion of the sonic nozzle which is used for this measurement is 1.5 mm.

Referring again to FIG. 1, the temperature of the fuel in the fuel tank 18 becomes higher and a larger amount of vapor is produced as the engine is driven for a longer time. Simultaneously, the pressure $P_1$ and the temperature $T_1$ within the surge tank 3 of the purge control valve 1 are also increased. An electric current is supplied to the ON-OFF valve 11 when the pressure $P_1$ exceeds a certain value. The valve disc 41 of the diaphragm-type poppet valve 4 rests on the seat portion 7 at the beginning. Accordingly, under such condition, the fuel vapor which has been produced in the fuel tank 18 and stored in the surge tank 3 of the purge control valve 1, is not purged into the intake pipe 9.

When the driving time of the engine becomes longer, the amount of the vapor generated in the fuel tank 18 is gradually increased. If the pressure $P_1$ detected by the pressure sensor 8 exceeds a predetermined value $P_B$ (for example, 50 mmHg), the electronic control unit (ECU) 19 operates the ON-OFF valve 11 to open. As a result, the negative pressure of the intake pipe is introduced into the diaphragm upper chamber 43 to move the diaphragm 42 upwardly, thereby lifting the poppet valve disc 41. When the poppet valve is opened, the fuel vapor in the surge tank 3 is purged through the sonic nozzle 2 into the intake pipe 9 of the engine. A purged flow rate (flow rate of the fuel vapor) at this time is calculated by the controller 19, based on the detected values of the pressure $P_1$ on the upstream side of the nozzle and the temperature $T_1$. The controller 19 operates the injector 12 in such a manner that a flow rate of the fuel to be injected by the injector 12 is subtracted by the purged flow rate.

Figure 3A:
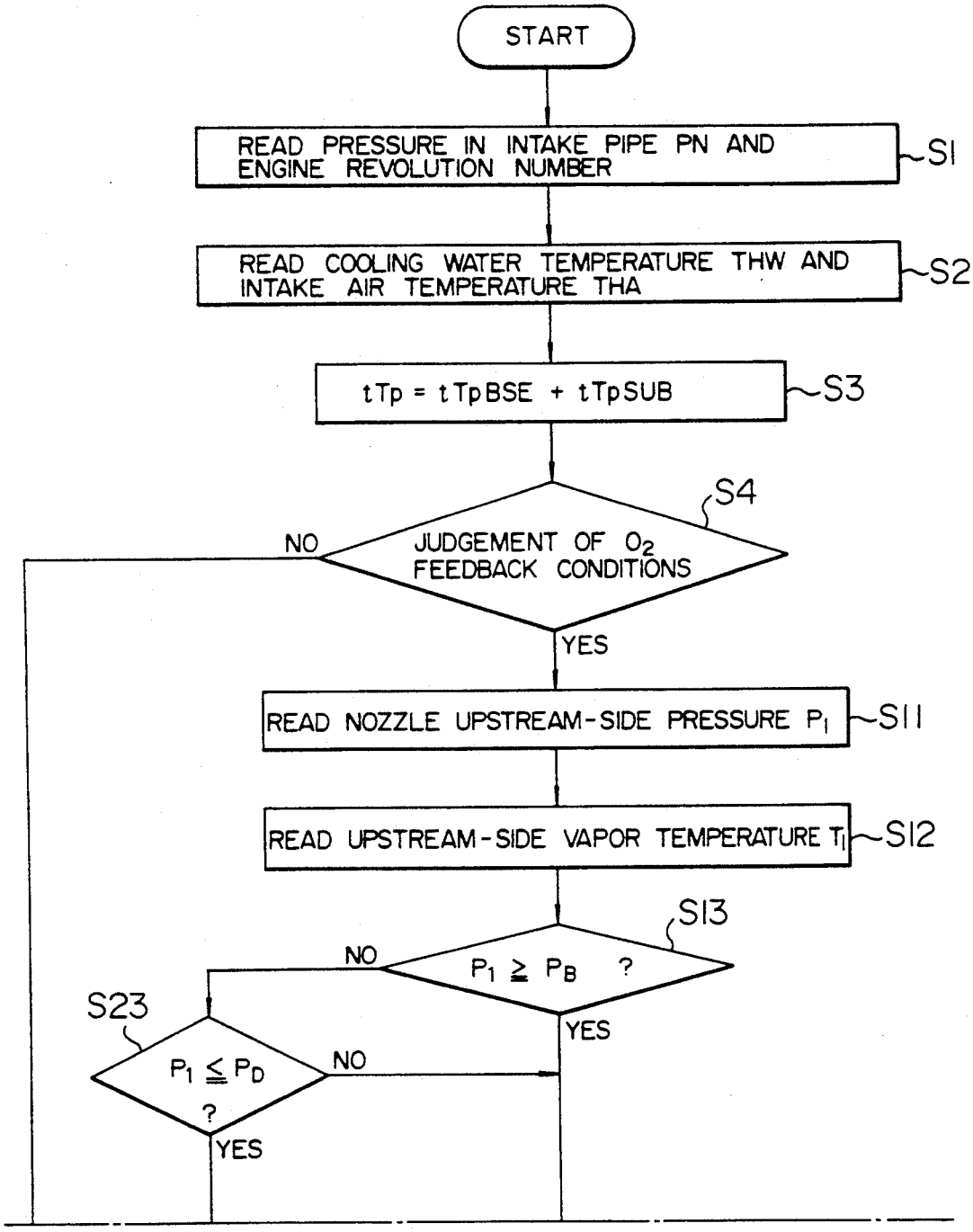
FIGS. 3A and 3B are a flowchart illustrating an operation of a controller in the first embodiment of the invention.
Figure 3B:
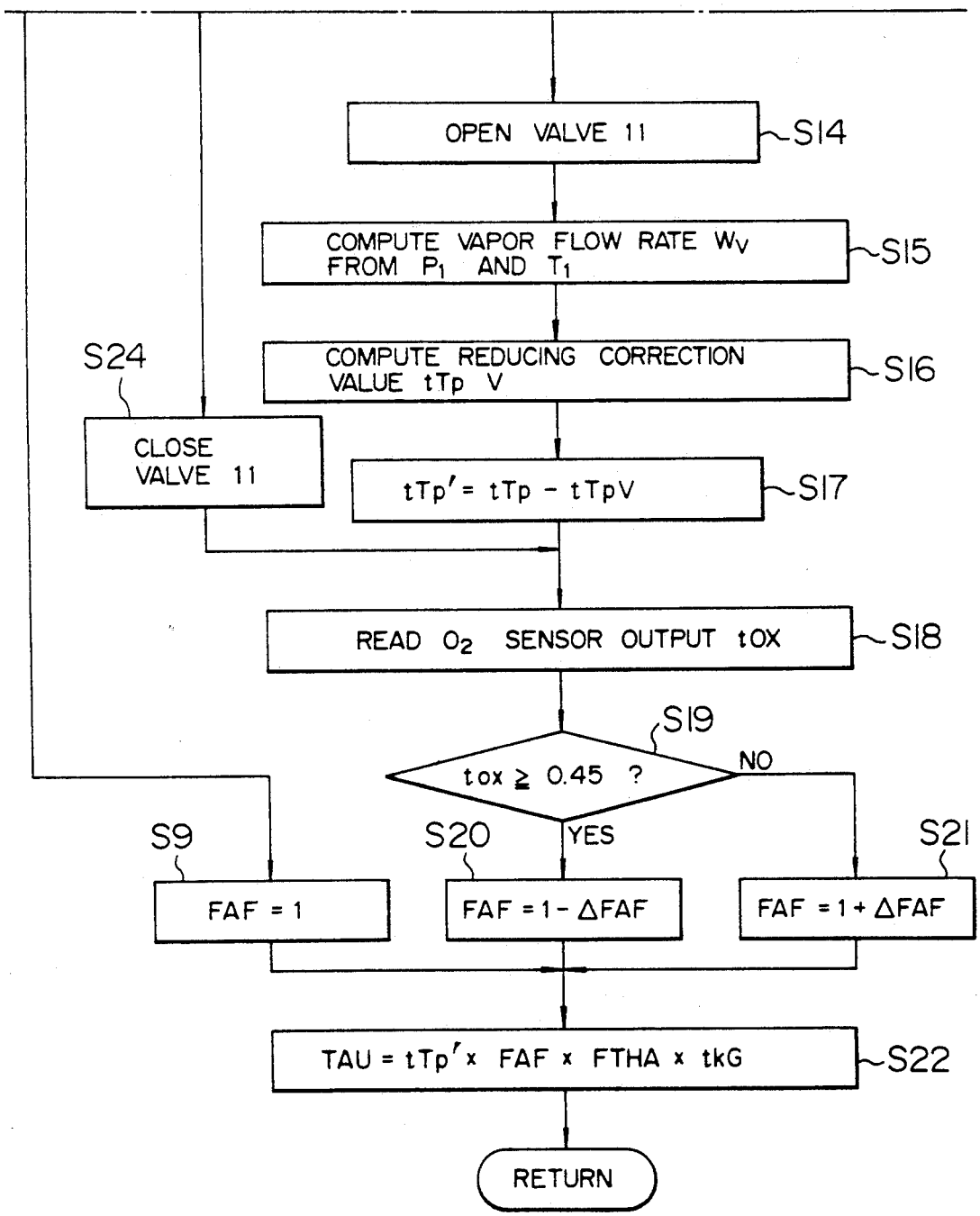

The above-mentioned operation of the purge system will no be described with reference to the flowchat of the controller shown in FIGS. 3A and 3B and the operation diagram of FIG. 4. Steps S1 to S4 in FIG. 3A are similar to the corresponding steps in FIG. 2, respectively.

Figure 4:
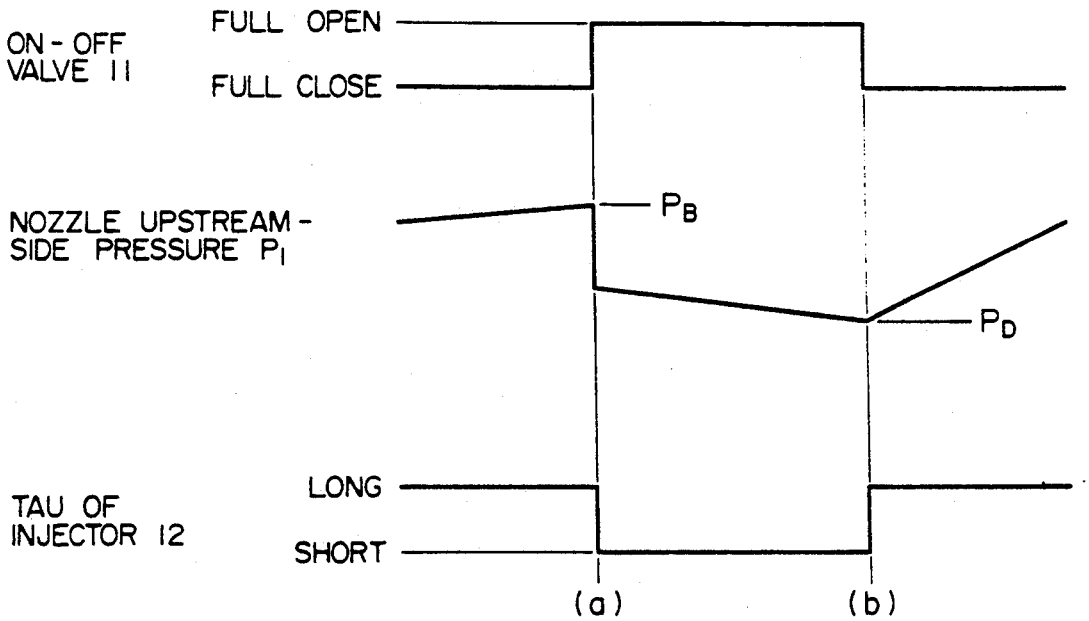
FIG. 4 is a time chart showing an operation of an evaporated fuel purge system in the first embodiment of the invention.

Additional procedures for the purge control are such that: the nozzle upstream-side pressure $P_1$ is read at Step 11; the nozzle upstream-side temperature $T_1$ is read at Step S12; and it is judged whether the pressure $P_1$ read at the step S11 is more than the predetermined pressure $P_B$ or not at a step S13, and if the pressure $P_1$ is more than $P_B$, the ON-OFF valve 11 is opened at a step S14 (refer to a of FIG. 4). In succession with this, at a step S15, a flow rate $W_v$ of the vapor flowing through the sonic nozzle 2 is calculated from the pressure $P_1$ and the temperature $T_1$ on the upstream side of the nozzle. Subsequently, at a step S16, the controller 19 finds a reduction correction value $tT^PV$, and at a step S17, the reduction correction value $tT^PV$ is subtracted from the reference injection time $tT^P$ and the injection time is renewed by the obtained Value $tT^{P'}$.

Thereafter, the program shifts to a step S18 where the output tOX of the $O_2$ sensor is read, prior to carrying out the feedback control of the air-fuel ratio. The steps S18 to S21 in FIG. 3B are similar to the steps S5 to S8 of FIG. 2, respectively. Finally, at the step S22, a final injection time TAU is calculated on the basis of $tT^{P'}$ found as the reference injection time at the step S17. Accordingly, when the nozzle upstream-side pressure $P_1$ is equal to or larger than the predetermined value $P_B$, an interval of the final injection time TAU is determined to be short, as indicated by a in FIG. 4, substantially simultaneously with the opening of the ON-OFF valve 11.

Meanwhile, at the step S13, when the nozzle upstream-side pressure $P_1$ is smaller than the predetermined value $P_B$, the program advances to a step S23. At step S23, the pressure $P_1$ is compared with a settled value $P_D$ (for example, 10 mmHg). When $P_1$ is larger than $P_D$, the program proceeds to the step S14. The ON-OFF valve 11 is thus in an opening state. In the case where the pressure $P_1$ is less than the settled value $P_D$, the program proceeds to a step 24 and the ON-OFF valve 11 is closed (see b of FIG. 4) to stop the purging of the vapor. In this case, the program detours around the steps S15 to S17 and arrives at the step S18. The program is processed at the steps S18 to S22 in this order, similarly to the case of FIG. 2. At the step S22, the basic injection time $tT^P$ is used for the calculation of the final injection time TAU.

Due to the aforesaid operation, when the engine is driven, the fuel vapor is hardly adsorbed by the canister 31. This is because the system controls the nozzle upstream-side pressure $P_1$ of the purge control valve 1 so a not to be larger than the predetermined pressure $P_B$ and the fuel vapor is purged through the purge, control valve 1 into the intake pipe 9, so that the pressure of the vapor line 30 does not increase over the valve opening pressure of the check valve 314. When the driving of the engine is stopped, the purging of the vapor by the purge control valve 1 is completed. However, the generation of the fuel vapor is not stopped immediately. At this time, the vapor is adsorbed by the canister 31 for the first time. The vapor continues to be produced in the fuel tank 18 until the temperature of the fuel is sufficiently lowered. The canister 31 mainly adsorbs the vapor which is produced until the fuel temperature is sufficiently lowered. Therefore, the adsorption capacity of the canister may be more reduced as compared with a conventional one.

When the engine is driven again to open the throttle valve 10 (at the time of running), the fuel vapor adsorbed by the canister 31 is purged through the purge line 32 into the intake pipe 9 of the engine, together with air from the atmosphere introduction port 313. Then, the purge control valve 1 starts to operate and prevents the vapor from flowing into the canister 31 from the vapor line 30 so that the vapor adsorbed by the canister 31 during stopping the engine can be sufficiently purged, and the canister 31 waits for the next stopping of the engine.

In the embodiment of FIG. 1, the poppet valve 4, the surge tank 3 and the sonic nozzle 2 are integrally formed with one another, but they may be formed separately so as to be connected to one another by means of conduits. Alternatively, the purge control valve 1 may be directly attached to the intake pipe 9. Further, as described above, the valve disc 41 of the poppet valve 4 is driven by the diaphragm 42, whereas it may be driven electrically by a solenoid valve instead of the diaphragm 42. In the described embodiment, the sonic nozzle 2 is employed for enlarging the range where the flow rate is constant. In place of the sonic nozzle, an orifice having a simpler structure may be employed for correcting the flow rate of the fuel.

Figure 6:
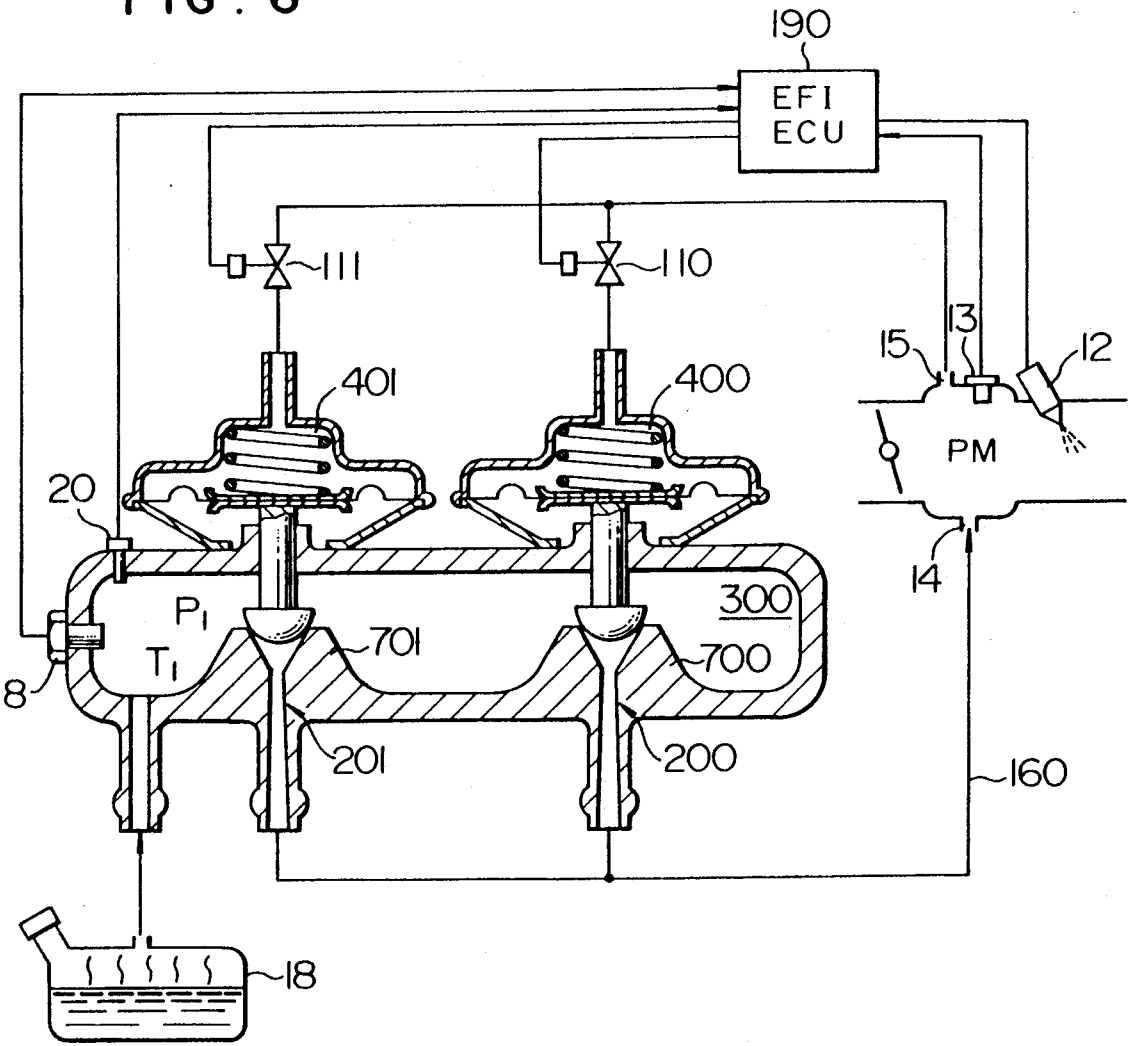
FIG. 6 is a view illustrative of the arrangement of an engine according to the second embodiment of the invention.

FIG. 6 is a view showing the arrangement of an engine according to the second embodiment of the invention. In FIG. 6, like reference numerals are appended to like elements of structure of the embodiment in FIG. 1, and a description thereof will be omitted herein.

The engine of the second embodiment of the invention is provided with two purge control valves. The engine of the illustrated embodiment differs from that of the first embodiment in that the purge control valves are selectively used in accordance with an amount of intake air to be sucked into the engine. The purge control valve 400 for high-load drive of the engine has a structure similar to that of the purge control valve 1 in the first embodiment shown in FIG. 1, but a sonic nozzle 200 of the valve 400 has a rather larger diameter of 1.8 mm. On the other hand, the purge control valve 401 for low-load drive of the engine also has a structure similar to that of the purge control valve 1, but a sonic nozzle 201 of the valve 401 has a rather smaller diameter of 1 mm. A surge tank 300 is common to the valves 400 and 401. Valve seat portions 700 and 701 for the valves 400 and 401 are formed on a lower wall portion of the surge tank, respectively. A pressure sensor 8 and a temperature sensor 20 are also common to the valves 400 and 401, the sensors being mounted on the surge tank 300. The purge control valves 400 and 401 communicate with the intake pipe 9 via ON-OFF valves 110 and 111, respectively. The ON-OFF valves 110 and 111 are connected to a controller 190.

The operation of the engine according to the second embodiment of the invention will now be described. When purging is executed during driving the engine at a high load such that a pressure PM in the intake pipe 9 is not more than −250 mmHg, the controller 190 receives a detection signal of the pressure sensor (MAP sensor) and outputs a valve opening command to the ON-OFF valve 110 for actuating the purge control valve 400. As mentioned above, because the sonic nozzle 200 of the purge control valve 400 has a large diameter, a flow rate of purging of evaporated fuel can be increased. When the engine is driven at the high load, an injection mount of the fuel is large so that it is not necessary to make a large reduction correction of an injection time of an injector 12 even if the purging flow rate is increased. In this way, the injection rate of the fuel can be controlled in the optimum condition.

Meanwhile, when the purging is executed during the low load driving of the engine such that the pressure in the intake pipe 9 is not less than −250 mmHg, the controller 190 outputs the valve opening command to the ON-OFF valve 111 for actuating the purge control valve 401. Since the sonic nozzle 201 of the valve 401 has a small diameter, the purging flow rate is restricted. When the engine is driven at the low load, the injection amount of the fuel is low so that it is not necessary to make a large reduction correction of the injection time of the injector 12 if the purging flow rate is restricted. The purge control valve of the illustrated embodiment are effective to minimize a variation of an air-fuel ratio caused when the system operation is switched over to select either one of starting and stopping operations of the purging.

In the second embodiment, the two purge control valves operate independently from each other, whereas the two valves 400 and 401 may be actuated simultaneously under the more high-load driving condition, for example, when the pressure in the intake pipe 9 is not more than −100 mmHg. In the second embodiment, the purge control valves are selectively used in accordance with the pressure in the intake pipe 9. Alternatively, the purge control valves may be selectively used, when the engine revolution number and the intake pipe pressure exceed predetermined values, or in accordance with a flow rate of sucked air which flow rate is detected by an air-flow meter (not shown).

Figure 7:
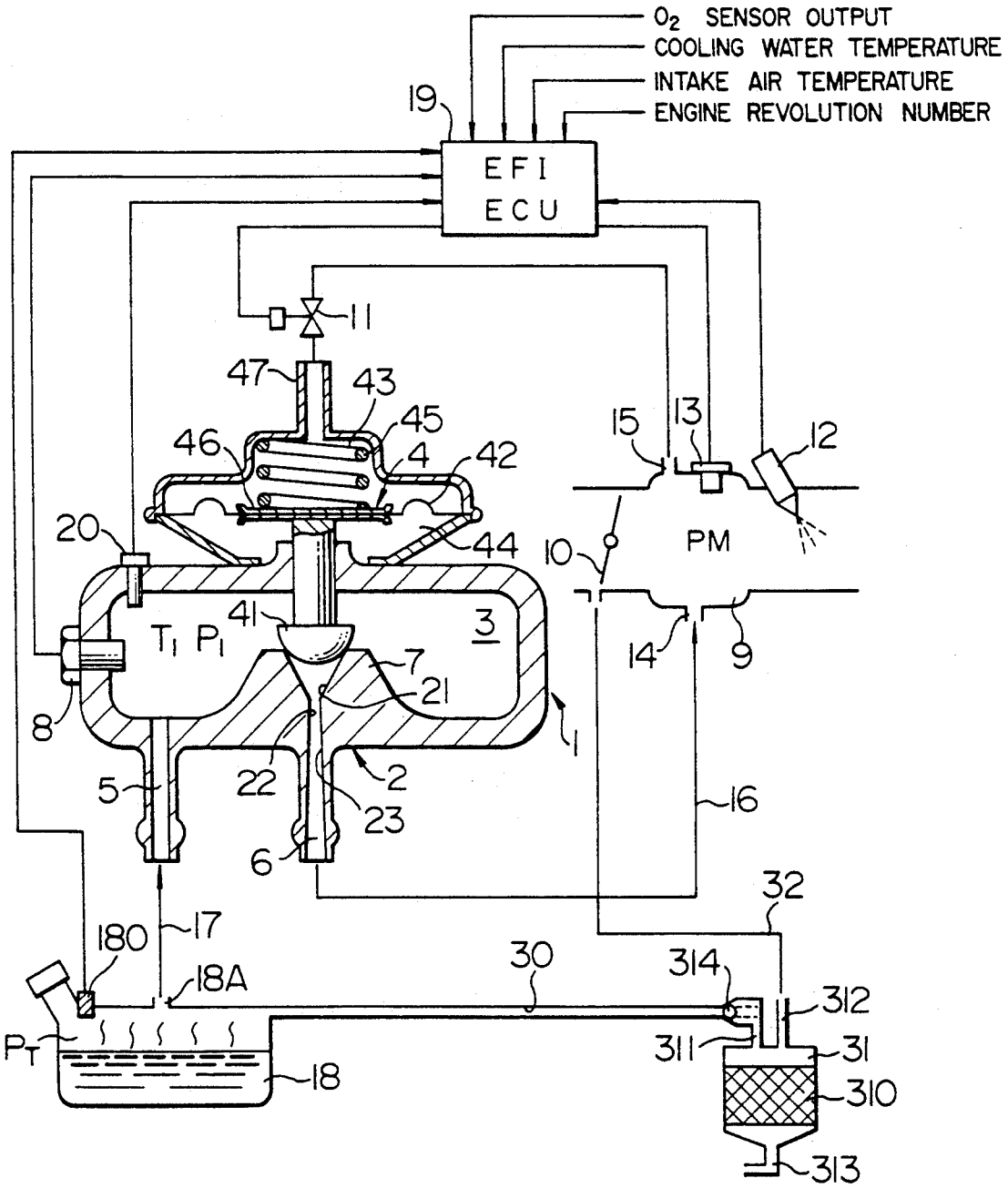
FIG. 7 is a view showing the arrangement of an engine according to the third embodiment of the invention.

Next, an engine according to the third embodiment of the invention will be explained with reference to FIGS. 7 and 8.

The engine of the illustrated embodiment is different from that of the first embodiment in that a pressure sensor 180 for detecting a pressure within a fuel tank 18 is provided. In the first embodiment, the ON-OFF valve 11 is opened or closed when the nozzle upstream-side pressure $P_1$ equals to the predetermined values $P_B$ or $P_D$. In the third embodiment, the ON-OFF valve is opened or closed in accordance with an internal pressure $P_T$ of the fuel tank. Similarly to the first embodiment, a purging rate $W_v$ is calculated on the basis of the pressure $P_1$ on the upstream side of the nozzle 2 and the temperature $T_1$ in the third embodiment.

Figure 8A:
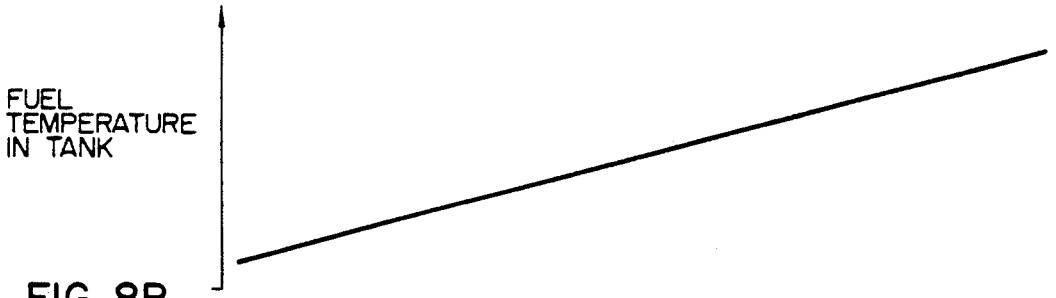
FIGS. 8A–C are a time charts illustrating an operation of an evaporated fuel purge system in the third embodiment of the invention.
Figure 8B:
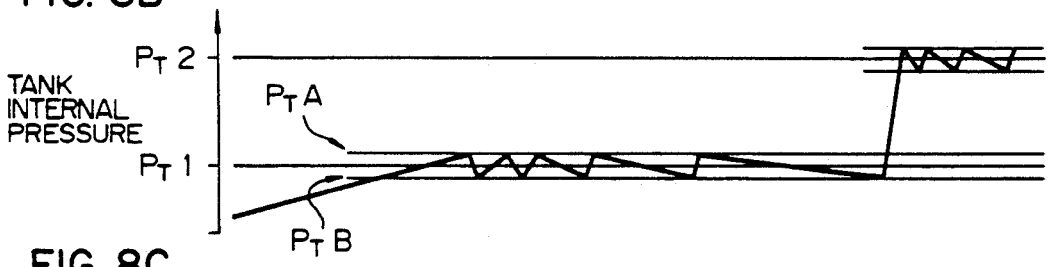
Figure 8C:
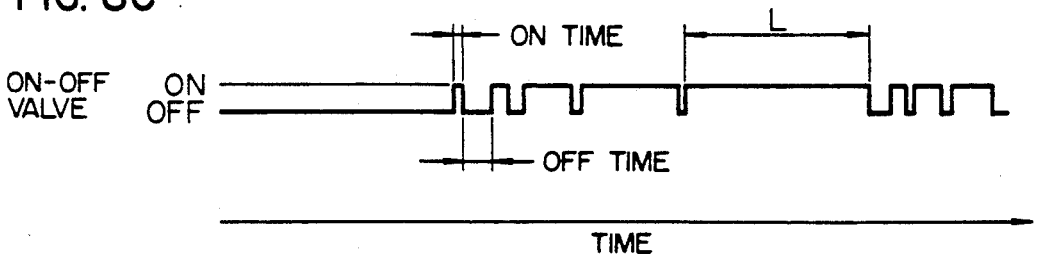

FIG. 8 is a time chart illustrating the operation of an evaporated fuel purge system in the third embodiment of the invention. When the driving of the engine starts, the temperature in the fuel tank increases and the tank internal pressure $P_T$ also increases with the lapse of time. When the tank internal pressure $P_T$ reaches a predetermined value $P_TA$, a controller opens the ON-OFF valve 11 to purge fuel vapor from the fuel tank 18 into an intake pipe 9. Once the purging starts, the internal pressure $P_T$ of the fuel tank decreases. When the internal pressure is lowered to a predetermined value $P_TB$, the ON-OFF valve 11 is closed. Thereafter, these operations are repeatedly continued to suitably control the system such that the tank internal pressure substantially equals to $P_T1$.

Further, in this embodiment, an expected value of the tank internal pressure is predetermined in each of two stages. More specifically, when the fuel temperature is low, the amount of fuel vapor is small so that the tank internal pressure increases slowly even if the ON-OFF valve 11 is closed. When the valve 11 is opened, the tank internal pressure decreases rapidly, and accordingly, an interval of the valve opening time is short. On the other hand, the high-fuel temperature promotes the fuel evaporation in the tank 18. In this connection, the tank internal pressure increases quickly when the ON-OFF valve 11 is closed. Even when the valve 11 is opened, the tank internal pressure decreases gently, so that the valve opening time is elongated. There is a possibility that the tank internal pressure will not be kept constant if the fuel temperature further continues to increase, even when the ON-OFF valve 11 is in an opening state. Accordingly, in the illustrated embodiment, when the interval of the opening time of the valve 11 reaches a certain length L, the predetermined value of the tank internal pressure is modified from $P_T1$ to $p_T2$.

Since the aimed value of the tank internal pressure is predetermined in such a manner as mentioned above, a substantially constant tank internal pressure $P_T$ can be obtained, and the nozzle upstream-side pressure $P_1$ becomes substantially constant as well, which facilitates the system to be controlled. An operation of the evaporated fuel purge system according to this embodiment is similar to that of the first embodiment. Besides, though the predetermined value of the internal pressure of the tank is changed in accordance with the length L of the opening time of the valve 11 in this embodiment, the predetermined internal pressure value may be changed in accordance with the temperature of the fuel. In order to prevent the vapor from flowing into the canister 31 without effectiveness of the tank internal pressure, a valve may be provided on the vapor line 30, the valve being arranged to open only when the engine operation is stopped.

Although the present invention has been described based on the preferred embodiments so far, it should be understood that the invention disclosed herein is not limited solely to the above-described specific forms, but various modifications can be made or the invention may be embodied in other forms without departing from the scope of claims appended hereto. More specifically, in the first to third embodiments of the invention, it has been described that a reduction correction of the fuel injection rate is made in a range where the $O_2$ feedback conditions are satisfied. However, the system may be arranged in such a manner that the purging rate of the evaporated fuel is subtracted from the reference injection rate when the temperature of the engine cooling water is low. This is applicable in the operating state immediately after the engine starts when the $O_2$ sensor has not been activated yet and similarly in the air-fuel ratio predetermined range during the high speed and high load operation, such as when the high power is demanded.

Further, although the invention is intended to control also the air-fuel ratio of the engine main body, the controller of the invention can be used as an instrument for measuring a production amount of the evaporated fuel because the controller calculates the purging rate of the fuel vapor. An engine according to the fourth embodiment of the invention, having the above function, will be described hereinafter with reference to FIGS. 9 to 11.

Figure 9:
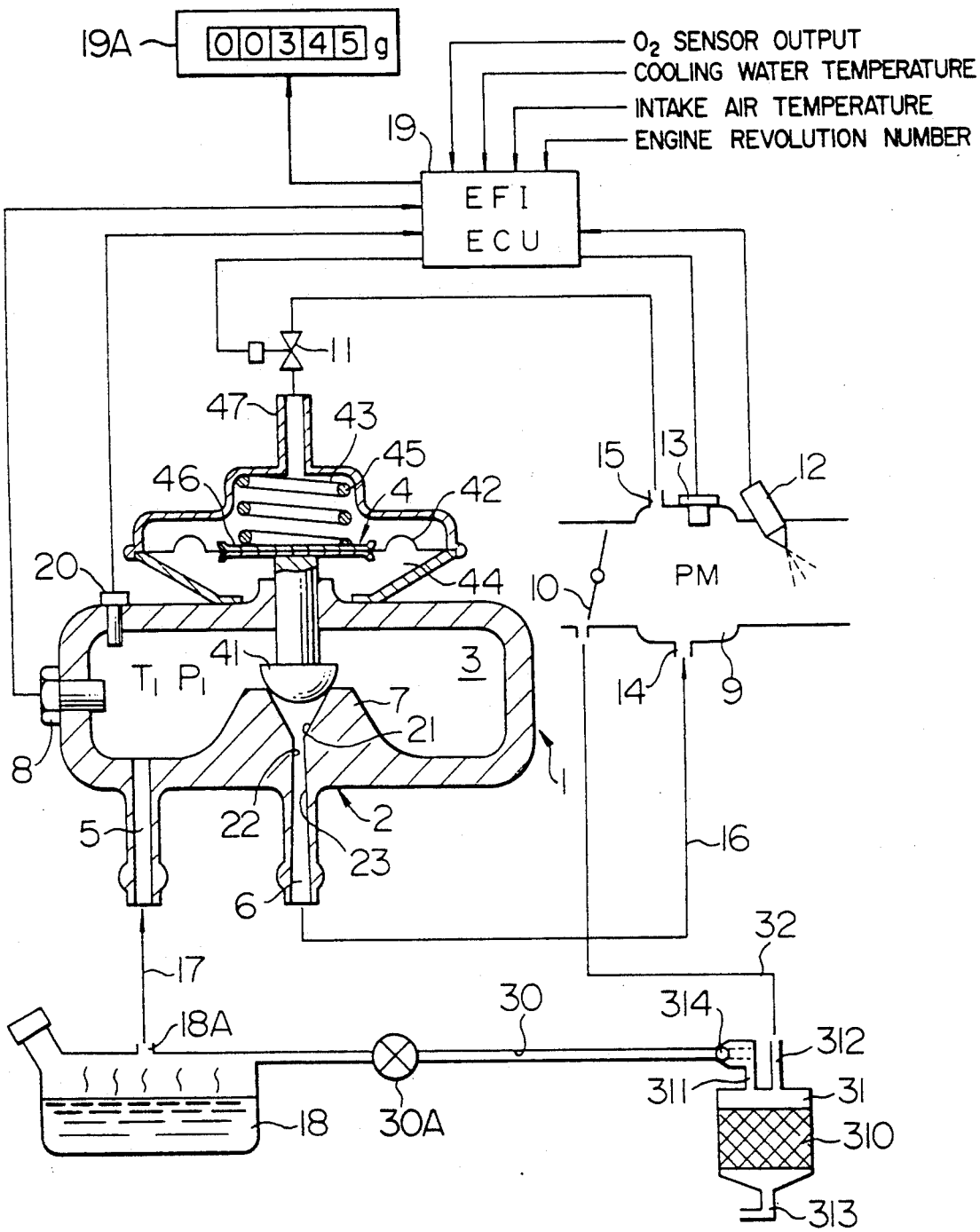
FIG. 9 is a view showing the arrangement of an engine according to the fourth embodiment of the invention.

FIG. 9 illustrates the arrangement of a measuring system which differs from the embodiment of FIG. 1 in that the controller 19 is provided with a vapor amount indicator 19A and a valve 30A is provided on the vapor line 30, and that a system control different from the first embodiment is performed. The vapor amount indicator 19A digitally indicates a purging amount calculated by the controller 19, and if the nozzle upstream side pressure and temperature are known, the purging amount can be calculated and indicated every moment. The operation of the illustrated measuring system will be explained, referring to the flowchart of FIG. 10 and a time chart of FIG. 11.

Figure 10:
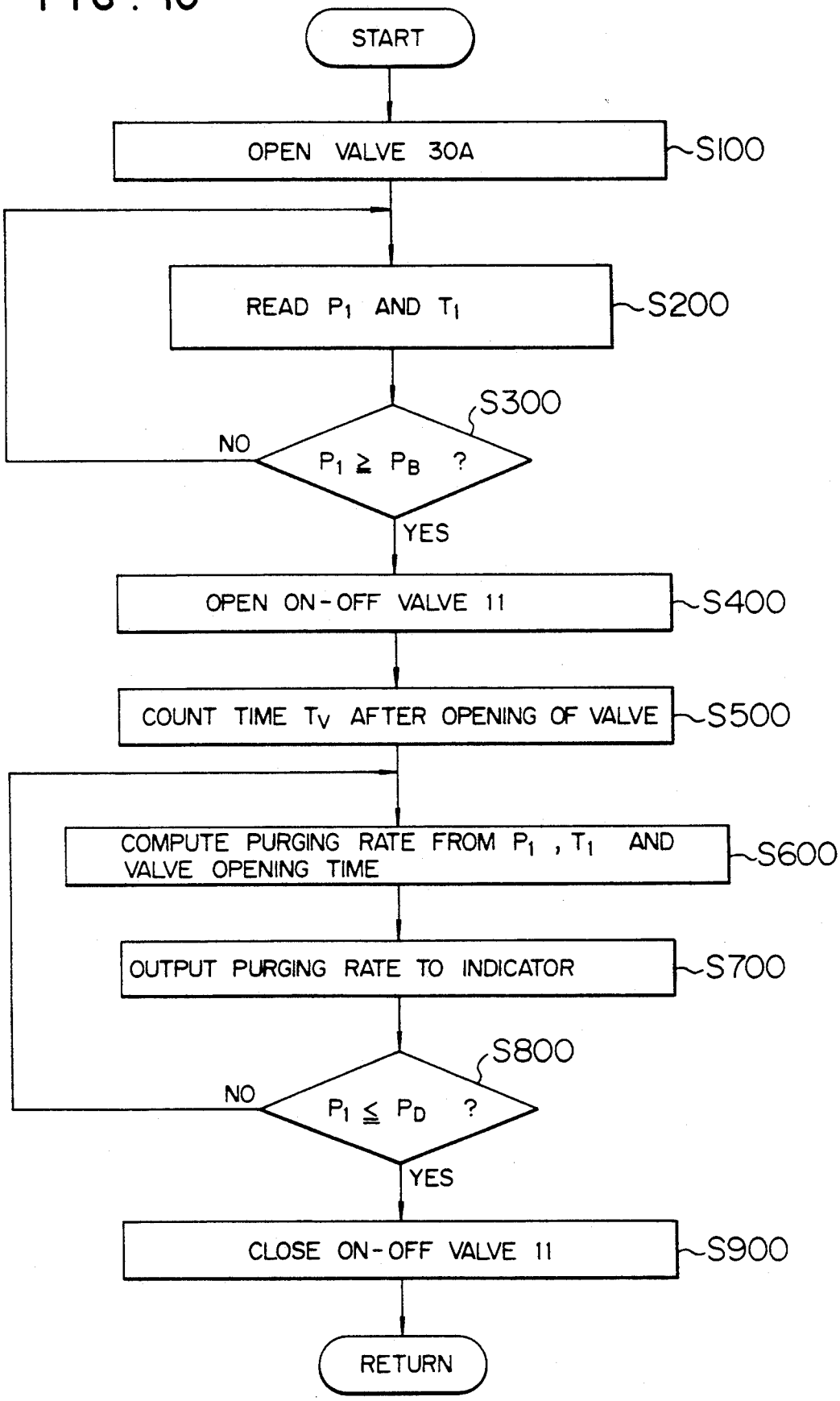
FIG. 10 is a flowchart illustrating an operation of a controller in the fourth embodiment of the invention.

In FIG. 10, when the program starts, the valve 30A is closed at a step S100 first, in order to completely prevent the evaporated fuel in a fuel tank 18 from flowing into a canister 31. Subsequently, the program proceeds to a step S200, where a nozzle upstream-side pressure $P_1$ and a vapor temperature $T_1$ are read in a controller 19. At a step S300, it is judged if the read pressure $P_1$ exceeds the predetermined pressure $P_B$ or not. In case of exceeding $P_B$, the ON-OFF valve 11 is opened at a step S400 (see a of FIG. 11). Simultaneously, at a step S500, an interval of time $T_v$ during which the valve 11 is opened, is counted. At a step S600, a flow rate $W_v$ of vapor at a moment of flowing through a sonic nozzle 2 is calculated from the nozzle upstream-side pressure $P_1$ and the vapor temperature $T_1$. The calculated value and the time $T_v$ counted at the step S500 are multiplied together for calculating an integrated vapor amount (purging amount). At a step S700, the purging amount is displayed in the vapor amount indicator 19A at intervals of a predetermined time. Thereafter, when the nozzle upstream-side pressure $P_1$ starts to decrease, at a step S800, it is judged whether the pressure $P_1$ exceeds the predetermined pressure PD nor not. If it is judged that $P_1$ is not more than PD, at a step S900, the ON-OFF valve 11 is closed (see b of FIG. 11). When the ON-OFF valve 11 is closed, the nozzle upstream-side pressure $P_1$ starts to increase again. Once the pressure $P_1$ attains the predetermined value $P_B$, the above-described operation is repeated (see c of FIG. 11).

Figure 11:
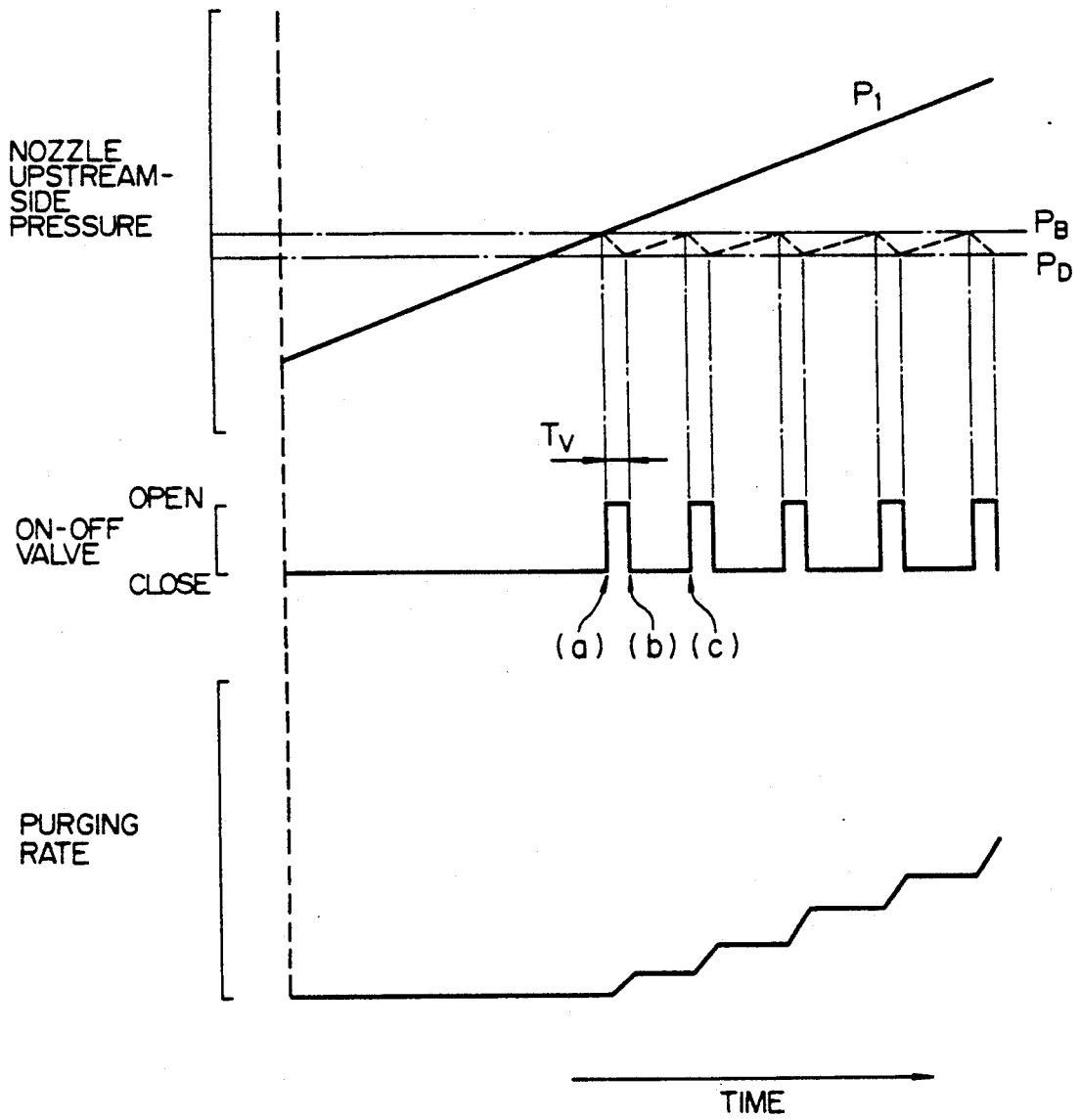
FIG. 11 is a time chart representing an operation of an evaporated fuel purge system in the fourth embodiment of the invention.

A solid line represented by $P_1$ in FIG. 11 indicates an increase of the nozzle upstream-side pressure when the ON-OFF valve 11 is closed. The purged flow rate (vapor flow rate) is shown as an integrated amount at the lower stage of FIG. 11. When the ON-OFF valve 11 is closed, the purged flow rate is kept at zero, and it increases when the valve 11 is opened. This figure indicates those values.

In the example of the measuring system described herein, the system is controlled in such a manner that the nozzle upstream-side pressure $P_1$ is kept constant, so that the integrated amount of the time when the fuel vapor flows through the sonic nozzle 2, that is, the time interval during which the ON-OFF valve 11 is opened, substantially relates to the vapor flow rate. Accordingly, this example of the system has an advantage such that the vapor flow rate can be measured with the inexpensive and simple structure.

As clearly understood from the above description, according to the invention, it is possible to readily and precisely measure the flow rate of the evaporated fuel to be purged and additionally mixed in the intake air of the engine. Therefore, the fuel can be utilized effectively by correctly decreasing the fuel supply amount from the injector by the amount of the fuel vapor to be purged. Also, the air-fuel ratio of the engine is not varied due to the fuel vapor to be purged, so that the engine can be driven stably in the optimum state.

Further, according to the invention, during driving the engine, the evaporated fuel is directly sucked into the intake pipe of the engine without flowing through the canister under all the driving conditions. Even when the charcoal canister is provided together with the purge system, the charcoal canister has only to adsorb the evaporated fuel merely during stopping the driving of the engine. Therefore, the invention allows the use of a relatively small-sized charcoal canister which has a small adsorption capacity and whose durability is improved.

What is claimed is:

1. An internal combustion engine comprising: a fuel tank; intake pipe means for supplying air to said engine; injector means for injecting fuel into a flow of the air passing through said intake pipe means; and an evaporated fuel purge system, said system including purge control valve means for causing an upper space of said fuel tank to communicate with said intake pipe means to thereby allow the evaporated fuel in said fuel tank to be sucked into said intake pipe means, control means for opening and closing said purge control valve means, and means for detecting a flow rate of the purged fuel vapor, said detecting means being connected to said control means which controls operation of said purge control valve means on the basis of an input from said detecting means; wherein said evaporated fuel purge system further comprises a throttle section provided in series with said purge control valve means for flowing the purged evaporated fuel at a constant flow rate, said detecting means including pressure and temperature sensors for detecting a pressure and a temperature of the evaporated fuel, respectively, which are located on the upstream side of any upstream one of said purge control valve means and said throttle section, in which controller a certain pressure value is predetermined to provide a critical pressure ratio at which the flow rate of the evaporated fuel at said throttle section equals to a sonic velocity, and said controller operating to open said purge control valve means when the detected value of said pressure sensor exceeds said predetermined value.

2. An internal combustion engine having: a fuel tank; intake pipe means for supplying air to said engine; injector means for injecting fuel into a flow of the air passing through said intake pipe means; and an evaporated fuel purge system, wherein said system includes an evaporated fuel flow line through which an upper space of said fuel tank communicates with said intake pipe means, at least one purge control valve for opening and closing said evaporated fuel flow line to supply the evaporated fuel of said fuel tank into said intake pipe means, a throttle section provided on said evaporated fuel flow line in series with said purge control valve, a pressure sensor for detecting a pressure in said evaporated fuel flow line on the upstream side of any one of said purge control valve and said throttle section, which is on the more upstream side than the other, a temperature sensor for detecting a temperature of said evaporated fuel flow line on the upstream side of said throttle section, and a controller operatively connected to said injector means, said purge control valve, said pressure sensor and said temperature sensor, in which controller a certain pressure value is predetermined for providing a critical pressure ratio at which a flowing velocity of the evaporated fuel at said throttle section equals to a sonic velocity, said controller operating to open said purge control valve when a detected value of said pressure sensor exceeds the predetermined pressure value, to count a time period during which said purge control valve is opened, to calculate a purged flow rate of the evaporated fuel based on the detected values of said pressure sensor and said temperature sensor and said period of the purge control valve opening time, and to make a correction of reducing a flow rate of the fuel to be injected from said injector means by a flow rate of the fuel corresponding to said purged flow rate of the evaporated fuel.

3. An engine according to claim 2, wherein when said purge control valve is opened, said controller effects a reduction correction of the flow rate of the fuel to be injected from said injector means by the flow rate corresponding to said purged flow rate of the evaporated fuel to newly memorize the thus reduction corrected fuel flow rate as a reference fuel injection rate, and said controller effects feedback control on the flow rate of the fuel injected from said injector means in a manner that a total air-fuel ratio including the flow rate corresponding to said purged rate may correspond to an aimed air-fuel ratio.

4. An engine according to claim 2, wherein said purge control valve is controlled to open when a pressure on the upstream side of said throttle section exceeds a predetermined value, and to close when the upstream-side pressure becomes below the predetermined value.

5. An engine according to claim 4, wherein said predetermined value of the pressure on the upstream side of said throttle section is determined in each one of multiple stages on the basis of any one of a fuel temperature and the period of said purge control valve opening time.

6. An engine according to claim 2, wherein said throttle section includes a tapered nozzle portion, a straight pipe portion and a flared pipe portion, said tapered nozzle portion, said straight pipe portion and said flared pipe portion being connected to one another continuously and smoothly.

7. An engine according to claim 2, wherein said purge control valve includes a surge tank formed on the upstream side with respect of a flow of fuel vapor from said fuel tank, and said throttle section formed on the downstream side of said fuel vapor flow, and said pressure sensor and said temperature sensor detect the pressure and the temperature within said surge tank, respectively.

8. An engine according to claim 2, further comprising charcoal canister means for adsorbing the fuel vapor, a second evaporated fuel flow line which communicates the upper space of said fuel tank with said intake pipe means through said charcoal canister means, and a check valve provided on said second evaporated fuel flow line, said check valve being arranged to open over said predetermined pressure value.

9. An engine according to claim 2, wherein a plurality of purge control valves are provided in parallel in said evaporated fuel flow line, said plurality of purge control valves are provided with throttle sections having different diameters from one another either on the downstream or upstream side with respect to the flow of the fuel vapor, and said plurality of purge control valves are selectively operated according to the operating condition of the engine.

10. An engine according to claim 2, further comprising a second pressure sensor for detecting a pressure of the evaporated fuel in said fuel tank, said second pressure sensor being operatively connected with said controller which operates to open said purge control valve when the pressure of the evaporated fuel in said fuel tank exceeds the predetermined value and to close said purge control valve when the pressure becomes below the predetermined value.

11. An internal combustion engine having: a fuel tank; intake pipe means for supplying air to said engine; injector means for injecting fuel into a flow of the air passing through said intake pipe means; and an evaporated fuel purge system, wherein said system includes an evaporated fuel flow line through which an upper space of said fuel tank communicates with said intake pipe means, at least one purge control valve for opening and closing said evaporated fuel flow line to supply the evaporated fuel of said fuel tank into said intake pipe means, a throttle section provided on said evaporated fuel flow line in series with said purge control valve, a pressure sensor for detecting a pressure in said evaporated fuel flow line on the upstream side of any one of said purge control valve and said throttle section, which is on the more upstream side than the other, a temperature sensor for detecting a temperature of said evaporated fuel flow line on the upstream side of said throttle section, and a controller operatively connected to said injector means, said purge control valve, said pressure sensor and said temperature sensor, in which controller a certain pressure value is predetermined for providing a critical pressure ratio at which a flowing velocity of the evaporated fuel at said throttle section equals to a sonic velocity, said controller operating to open said purge control valve when a detected value of said pressure sensor exceeds the predetermined pressure value, to count a time period during which said purge control valve is opened, to calculate a purged flow rate of the evaporated fuel on the basis of the detected values of said pressure sensor and said temperature sensor and said period of the purge control valve opening time, and to indicate said calculated purged flow rate.

12. An engine according to claim 11, further comprising a second pressure sensor for detecting a pressure of the evaporated full in said fuel tank, said second pressure sensor being operatively connected with said controller which operates to open said purge control valve when the pressure of the evaporated fuel in said fuel tank exceeds the predetermined value and to close said purge control valve when the pressure becomes below the predetermined value.

* * * * *